US007146835B2

(12) United States Patent
Hruschak et al.

(10) Patent No.: US 7,146,835 B2
(45) Date of Patent: Dec. 12, 2006

(54) METHOD AND APPARATUS TO REDUCE SLOT WIDTH IN TUBULAR MEMBERS

(75) Inventors: Lawrence Alexander Hruschak, Ft. Saskatchewan (CA); Terry James McLean, Sherwood Park (CA); Richard Todd Ariss, Spruce Grove (CA)

(73) Assignee: International Roller Technology, Inc., St. Michael (BB)

( * ) Notice: Subject to any disclaimer, the term of this patent is extended or adjusted under 35 U.S.C. 154(b) by 135 days.

(21) Appl. No.: 10/825,959

(22) Filed: Apr. 16, 2004

(65) Prior Publication Data

US 2004/0244449 A1 Dec. 9, 2004

Related U.S. Application Data

(60) Provisional application No. 60/463,917, filed on Apr. 17, 2003.

(51) Int. Cl.
*B21B 37/24* (2006.01)

(52) U.S. Cl. ..... 72/7.1; 72/7.4; 72/95; 72/100; 72/121

(58) Field of Classification Search ..... 72/77, 72/78, 95, 100, 121, 7.1, 7.4, 8.3, 11.1; 29/896.61, 29/896.62

See application file for complete search history.

(56) References Cited

U.S. PATENT DOCUMENTS

| | | | |
|---|---|---|---|
| 965,855 | A | 8/1910 | Baur |
| 1,027,917 | A | 5/1912 | Smith |
| 1,028,065 | A | 5/1912 | Smith |

(Continued)

FOREIGN PATENT DOCUMENTS

| | | |
|---|---|---|
| CA | 2188743 | 12/1996 |

(Continued)

OTHER PUBLICATIONS

Kaiser, T.M.V. et al., "Inflow Analysis and Optimization of Slotted Liners" Available online at <http://www.spe.org>, SPE eLibrary paper No. 80145, Aug. 16, 2002 (date accessed Jan. 13, 2004).

(Continued)

*Primary Examiner*—Ed Tolan
(74) *Attorney, Agent, or Firm*—Greenlee, Winner and Sullivan, P.C.

(57) ABSTRACT

An apparatus and method are provided for reducing the width of a plurality of longitudinal slots or other openings spaced circumferentially around a slotted tubular member. The invention includes a seaming roller positioned to contact the outer surface of the slotted tubular member for transverse movement across the plurality of slots, and adapted to apply a force onto the slotted tubular member so as to reduce the slot width. The width of the plurality of slots is detected and compared to a set value indicative of a desired end slot width and based on this comparison, an adjustor connected to the seaming roller, adjusts the force applied by the seaming roller to the plurality of slots. Each opening is adjusted by the seaming roller to have a profile with a width that throughout the length of the slot profile, varies no more than a given tolerance from the desired end slot width. The invention also provides a slotted tubular liner comprising a metal slotted tubular member formed with a plurality of longitudinal slots ≦3.175 mm in width spaced circumferentially around the member, each slot having been cut and then transversely seamed to have a profile with a width tolerance, that throughout the length of the slot profile, varies no more than +/−0.0127 mm, and preferably varies no more than +/−0.00762 mm from a desired end slot width.

43 Claims, 13 Drawing Sheets

U.S. PATENT DOCUMENTS

| | | | | | |
|---|---|---|---|---|---|
| 1,028,066 | A | | 5/1912 | Smith | |
| 1,055,675 | A | | 3/1913 | Smith | |
| 1,207,808 | A | | 12/1916 | Steps | 72/203 |
| 1,207,809 | A | | 12/1916 | Steps | |
| 1,271,787 | A | | 7/1918 | Smith | |
| 1,566,624 | A | | 12/1925 | Smith | |
| 1,579,846 | A | | 4/1926 | Steps | |
| 1,652,208 | A | | 12/1927 | McEvoy, Jr. | |
| 1,654,160 | A | | 12/1927 | Coberly | |
| 1,654,618 | A | | 1/1928 | Steps | |
| 1,685,287 | A | | 9/1928 | McEvoy, Jr. | |
| 1,782,518 | A | | 11/1930 | Steps | 166/227 |
| 1,868,900 | A | | 7/1932 | Hayes | |
| 2,111,680 | A | | 3/1938 | Tow | 166/227 |
| 2,306,945 | A | | 12/1942 | Hebron | 72/181 |
| 2,358,873 | A | * | 9/1944 | Moss et al. | 72/100 |
| 3,009,177 | A | | 11/1961 | Carusi et al. | |
| 3,327,512 | A | | 6/1967 | Novak | |
| 3,520,418 | A | | 7/1970 | Guinard | |
| 4,076,136 | A | * | 2/1978 | Jenkin | 414/433 |
| 4,179,911 | A | | 12/1979 | Saier | |
| 4,312,207 | A | * | 1/1982 | Przybyla et al. | 72/100 |
| 4,429,445 | A | * | 2/1984 | Fuminier | 29/33 T |
| 4,932,112 | A | | 6/1990 | Tikkanen | |
| 5,046,892 | A | | 9/1991 | Kothmann | 405/43 |
| 6,112,570 | A | | 9/2000 | Hruschak | 72/370.27 |
| 6,726,461 | B1 | * | 4/2004 | Hyvarinen et al. | 425/80.1 |
| 2003/0062170 | A1 | | 4/2003 | Slack | 166/377 |
| 2004/0016278 | A1 | | 1/2004 | Douman et al. | |
| 2004/0035169 | A1 | | 2/2004 | Slack | 72/78 |

FOREIGN PATENT DOCUMENTS

| | | |
|---|---|---|
| CA | 2183032 | 2/1998 |
| CA | 2299092 | 5/2000 |
| CA | 2324730 | 4/2002 |
| DE | 3213464 | 10/1983 |
| EP | 0 297 552 | 12/1993 |
| JP | 54-043836 | 4/1979 |
| WO | WO03/051567 | 6/2003 |

OTHER PUBLICATIONS

Regent Control Systems "Traverse Rolled Slotted Liner-Regent TRS™" Available online at <http://www.regentcontrol.com/Product.html> (date accessed Mar. 4, 2003).

Slotwell Ltd. "Precise Manufacturing of Slotted Liner" Available online at http://www.slotwell.com (date accessed Dec. 23, 2002).

Valley Perforating Co., "MESH vs Slot Width, about Mill Slotted Liner: Perforating Options" Available online at <http://valleyperf.com/information.html> (date accessed Dec. 23, 2002).

* cited by examiner

METHOD AND APPARATUS TO REDUCE SLOT WIDTH IN TUBULAR MEMBERS

CROSS-REFERENCE TO RELATED APPLICATIONS

This application claims benefit of U.S. Provisional Application No. 60/463,917 filed Apr. 17, 2003, which is incorporated herein to the extent not inconsistent herewith.

FIELD OF THE INVENTION

The invention relates to both a method and an apparatus to reduce the slot width in slotted tubular members, such as tubular liners.

BACKGROUND OF THE INVENTION

Slotted tubular members, known as slotted tubular liners or slotted metal pipes, are used in the oil industry, and in other industries, as screens to limit the amount of sand entering a well. The equipment which is used to cut these slots circumferentially around the tubular members is capable of forming slots having a width of about 0.015" (thou=thousandths of an inch) or 0.381 mm. Slot widths less than 15 thou (0.381 mm) are needed in most industries in order to exclude sand. While equipment may be capable of cutting narrower slots, normally seaming equipment is used. Seaming equipment applies pressure to the tubular member in the vicinity of the slot to both narrow the slot width at the exterior surface of the tubular member, and to form a slot profile known as a "keystone slot." Canadian Patent 2,183,032 issued Jul. 17, 2001 to I.S.I. Canada Inc. describes one method of reducing slot width in such tubular liners. Pressure is applied with a seaming roller to the exterior surface of a slotted pipe along the longitudinal peripheral edges of the slot until the metal pipe is deformed to close the slot to a desired width. Another scheme for reducing slot width is described in Canadian Patent No. 2,324,730 issued on Aug. 12, 2003 and reissued on Mar. 16, 2004, to Regent Technologies Ltd. This patent describes a method wherein the seaming roller traverses the slot in a helical sweep pattern in order to reduce the slot width. The apparatus described to accomplish this includes a rotating forming head equipped with three hydraulic actuators which apply a load to three forming rollers.

SUMMARY OF THE INVENTION

The above described methods for reducing slot width in tubular members have short comings which are addressed by the present invention. While Canadian Patent No. 2,324,730, issued to Regent Technologies Inc., recognizes an improved approach compared to I.S.I Canadian Patent No. 2,183,032, in traversing the slot in order to reduce slot width, the apparatus disclosed to accomplish this is limited to a rotating forming head with rigid hydraulic actuator control. Canadian Patent No. 2,324,730, fails to address certain problems recognized by the inventors of this patent application as follows:

1. A rotating forming head with rigid actuators poses limitations on the ability to maintain or adjust the deforming force. In order to rotate a forming head, the fluid pressure delivered by the hydraulic actuators must be fixed prior to rotation. No mechanism is provided to change the deforming force applied by the rollers along each slot, or from slot to slot. With a rotating head, it is not feasible to provide for such adjustments.
2. As the seaming roller traverses the slot, it drops into and climbs out of the slot profile. Some mechanism is needed to hold the desired deforming force across the slot.
3. As the tubular member may be out of round, some mechanism is needed to hold the deforming force around the circumference.
4. The saws which cut the slots are generally incapable of maintaining uniform slot width. Burrs form as the blade is pulled out of the slot. In the mid section of the slot, the blade wobble generally results in a wider cut. As the slot width is not even over the length of the slot, some mechanism is needed to adjust the pressure along the length of the slot in order to achieve the desired narrowing of the slot width to create a consistent slot width throughout the length of the slot.
5. In most tubular members, the slots are often aligned around the liner circumference, making the tubular member more flexible in this slotted regions. Some mechanism is needed to adjust the deforming force applied by the rollers between the more rigid non-slotted regions and the slotted regions of the pipe. Some mechanism is also needed to adjust the deforming force applied by the rollers between the end of the slots and the middle of the slots. There should be some mechanism to maintain quality control of slot width over the entire length of a tubular member given that the flexibility of the tubular member changes over its length and that different pipes have different inherent hardness strengths.

The apparatus and method of the present invention address these short comings of the prior art and achieve improved tolerance and width control in narrow slots in slotted tubular liners.

In a broad aspect, the present invention provides a method of reducing the width of a plurality of slots (preferably longitudinal slots) or other openings spaced circumferentially around a slotted tubular member, comprising:

providing at least one seaming roller positioned to contact the outer surface of the slotted tubular member for transverse movement relative to the longitudinal axis of the slotted tubular member, preferably across the plurality of slots;

detecting an initial width of each of the plurality of slots to generate a detection signal proportional to the detected initial width;

comparing the detected initial width of the slots to a set value indicative of a desired end slot width to generate a correction signal proportional to the difference;

applying a downward force onto the slotted tubular member with the at least one seaming roller, and;

varying the force applied by the at least one seaming roller to the plurality of slots along the slotted tubular member in response to the correction signal.

In another broad aspect, the present invention provides an apparatus for reducing the width of a plurality of longitudinal slots or other openings spaced circumferentially around a slotted tubular member comprising:

a seaming roller positioned to contact the outer surface of the slotted tubular member for transverse movement across the plurality of slots, and adapted to apply a force onto the slotted tubular member so as to reduce the slot width;

first detecting means or a first detector adjacent the seaming roller for detecting all initial width of the plurality of slots and generating a detection signal proportional to the detected initial width;

comparing means or a comparator connected to the first detecting means or the first detector for comparing the detected initial width to a set value indicative of a desired end slot width and to generating a correction signal proportional to the difference;

varying means or an adjustor connected to the seaming roller and the comparing means or the comparator, for varying or adjusting the force applied by the seaming roller to the plurality of slots in response to the correction signal.

In yet another broad aspect, the present invention provides a method of reducing the width of a plurality of longitudinal slots or other openings spaced circumferentially around a slotted tubular member, comprising:

providing at least one seaming roller positioned to contact the outer surface of the slotted tubular member for transverse movement across the plurality of slots;

applying a downward force onto the slotted tubular member with the at least one seaming roller; and maintaining the force applied by the at least one seaming roller as the seaming roller moves across each of the plurality of slots with an accumulator.

In another broad aspect, the present invention provides a method of reducing the width of a plurality of longitudinal slots or other openings spaced circumferentially around a slotted tubular member, comprising:

providing at least one seaming roller positioned to contact the outer surface of the slotted tubular member for transverse movement across the plurality of slots;

applying a downward force onto the slotted tubular member with the at least one seaming roller; and longitudinally feeding and axially rotating the slotted tubular member through the at least one seaming roller.

In another broad aspect, the present invention provides a slotted tubular liner comprising: a metal slotted tubular member formed with a plurality of longitudinal slots ≦3.175 mm in width spaced circumferentially around the member, each slot having been cut and then transversely seamed to have a profile with a width tolerance, that throughout the length of the slot profile, varies no more than +/−0.0127 mm, and preferably varies no more than +/−0.00762 nun from a desired end slot width.

In another broad aspect, the present invention provides a method of forming a slotted tubular member having a plurality of longitudinal slots comprising:

providing at least one seaming roller positioned to contact the outer surface of the slotted tubular member for transverse movement across the plurality of slots;

detecting a width of each of the plurality of slots to generate a detection signal proportional to the detected width;

comparing the detected width of the slots to a set value indicative of a desired end slot width to generate a correction signal proportional to the difference;

applying a downward force onto the slotted tubular member with the at least one seaming roller; and varying the force applied by the at least one seaming roller to the plurality of slots along the slotted tubular member in response to the correction signal so that each opening has a profile with a width tolerance, that throughout the length of the slot profile, varies no more than +/−0.0381 mm from a desired end slot width, preferably varies no more than +/−0.0127 mm from a desired end slot width, and most preferably varies no more than +/−0.00762 mm from a desired end slot width.

In another broad aspect, the present invention provides an apparatus for reducing the width of a plurality of longitudinal slots or other openings spaced circumferentially around a slotted tubular member comprising:

a seaming roller positioned to contact the outer surface of the slotted tubular member for transverse movement across the plurality of slots, and adapted to apply a force onto the slotted tubular member so as to reduce the slot width;

first detecting means or a first detector adjacent the seaming roller for detecting a width of the plurality of slots and generating a detection signal proportional to the detected width;

comparing means or a comparator connected to the detecting means or the first detector for comparing the detected width to a set value indicative of a desired end slot width and to generating a correction signal proportional to the difference;

varying means or adjustor connected to the seaming roller and the comparing means or comparator, for varying or adjusting the force applied by the seaming roller to the plurality of slots in response to the correction signal.

In yet another broad aspect, the present invention provides a method of reducing the width of a plurality of longitudinal slots or other openings spaced circumferentially around a slotted tubular member, comprising:

providing at least one seaming roller positioned to contact the outer surface of the slotted tubular member for transverse movement across the plurality of slots;

detecting a width of each of the plurality of slots to generate a detection signal proportional to the detected width;

comparing the detected width of the slots to a set value indicative of a desired end slot width to generate a correction signal proportional to the difference;

applying a downward force onto the slotted tubular member with the at least one seaming roller; and varying the force applied by the at least one seaming roller to the plurality of slots along the slotted tubular member in response to the correction signal.

The invention in a preferred embodiment includes an apparatus and method for maintaining the force applied by the at least one seaming roller to the plurality of slots as the seaming roller moves across each slot. This is readily accomplished with gas compressed hydraulic accumulators on the seaming roller.

The invention in a preferred embodiment includes the slotted tubular member being made of metal having a plurality of longitudinal slots cut circumferentially around the member.

Other preferred embodiments of the apparatus and method of the invention include one or more of the following features:

detecting the final width of each of the plurality of slots, generating a final width signal proportional to the detected final width, and comparing the final width signal to the set value indicative of a desired end slot width;

moving the at least one seaming roller longitudinally along the length of the slotted tubular member;

optically detecting the width of the plurality of slots with a digital camera;

laser detecting the width of the plurality of slots with a laser and a laser detector.

As used herein and in the claims, the terms and phrases set out below have the meanings which follow.

"Width tolerance" is a measure of the difference between a set value indicative of a desired end slot width and the final width of a slot after the seaming process. For example, if a slotted tubular member has a set value indicative of a desired end slot width of 0.15 mm, and the desired width tolerance is +/−0.02 mm, then the final width of a slot after the seaming process should be in the range of 0.13–0.17 mm (or should not vary in width along the length of the slot by more than 0.02 mm). A final slot width within this range yields a slot width that is within a +/−0.02 mm width tolerance from the desired end slot width.

By "desired end slot width" is meant a slot width which is a set standard. For example, a standard set by the operator to achieve appropriate quality control or industry standard. This desired end slot width is generally less than 3.175 mm for oil and gas purposes but preferably is in the range of 0.0127 mm–3.175 mm.

By "longitudinal slot" is meant a slot cut generally along the longitudinal axis of the tubular member but includes slots formed at an angle less than 60° from the longitudinal axis.

"Roughness Average ($R_a$)" is a measure of the surface roughness of a slotted tubular member. The higher the $R_a$ value for a given slotted tubular member, the greater the number of protuberances or peaks and valleys present on the outer surface of the tubular member. The $R_a$ value is the arithmetic average of the absolute value of the measured profile height deviations taken within the sampling length and measured from the graphical centerline; it is a determination of the average linear deviation of the measured surface from the nominal surface. Roughness average is typically expressed in micrometers (μm).

"Ground Finished" describes a slotted tubular member or pipe that has been subjected to grinding in order to reduce the surface roughness of the outer surface. Typical $R_a$ values for ground finished pipes are in the range of 1.6–0.10 μm.

DESCRIPTION OF THE PREFERRED EMBODIMENTS

Figure 1:
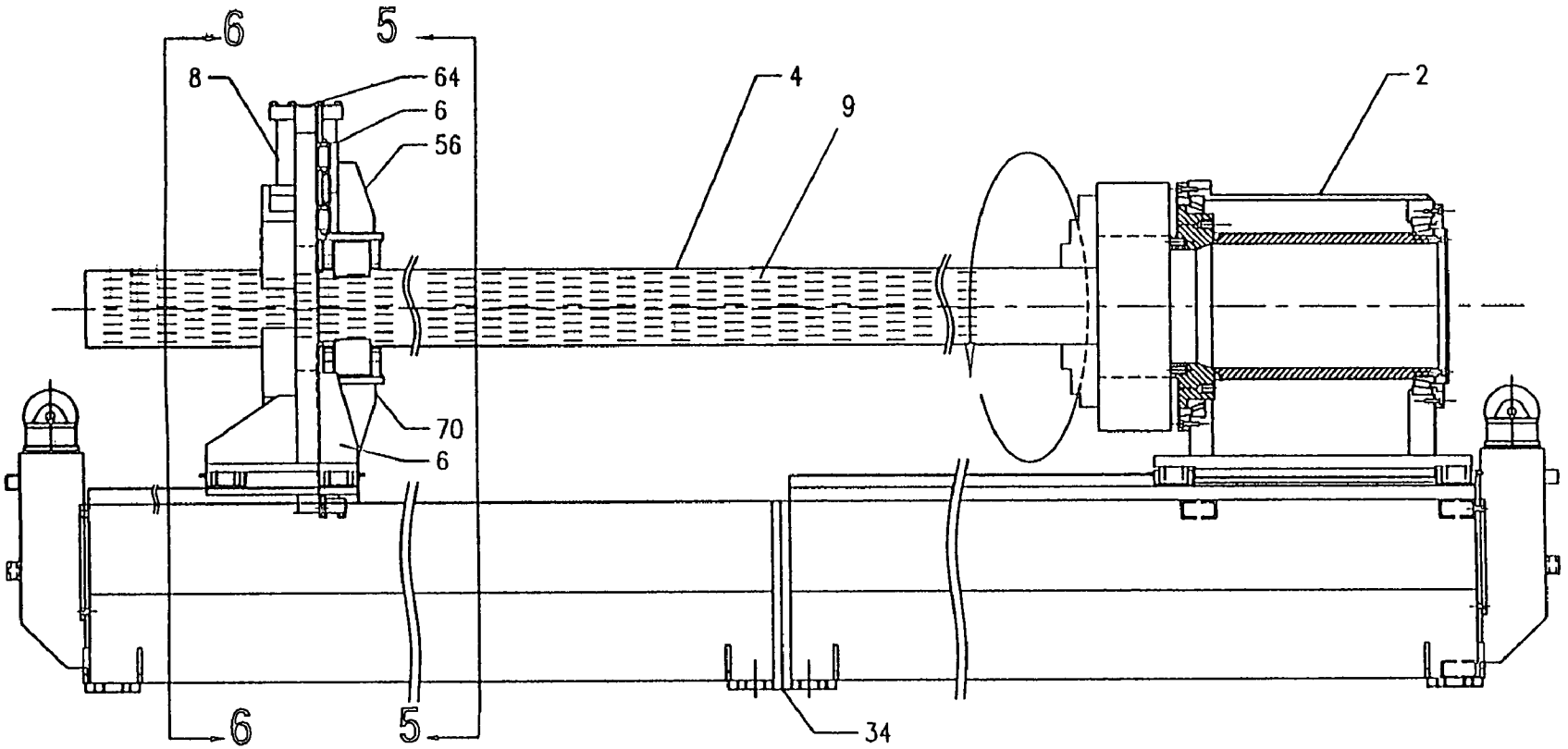
FIG. 1 is side view of the apparatus of the present invention, showing the head stock assembly in section to feed and rotate the slotted tubular member, the clamp roller assembly for positioning and centering the tubular member, and the seaming roller assembly for narrowing the slot width in a controlled manner.

The apparatus of the present invention as seen in FIG. 1 include three assemblies: the head stock assembly 2, which feeds and rotates the slotted tubular member or pipe 4 through the subsequent assemblies; the clamp roller assembly 6 which supports the slotted tubular member and applies force to the slotted tubular member wherein the force applied holds said member centered in place for passage through the multiple assemblies; and the seaming roller assembly 8 which applies deforming force to the slotted tubular member such that the force applied is directly proportional to the final slot width. These multiple assemblies are described hereinbelow, in association with a particular preferred embodiment. Together they cooperate to provide a high degree of quality control over the slot width of a given slot 9.

Figure 2:
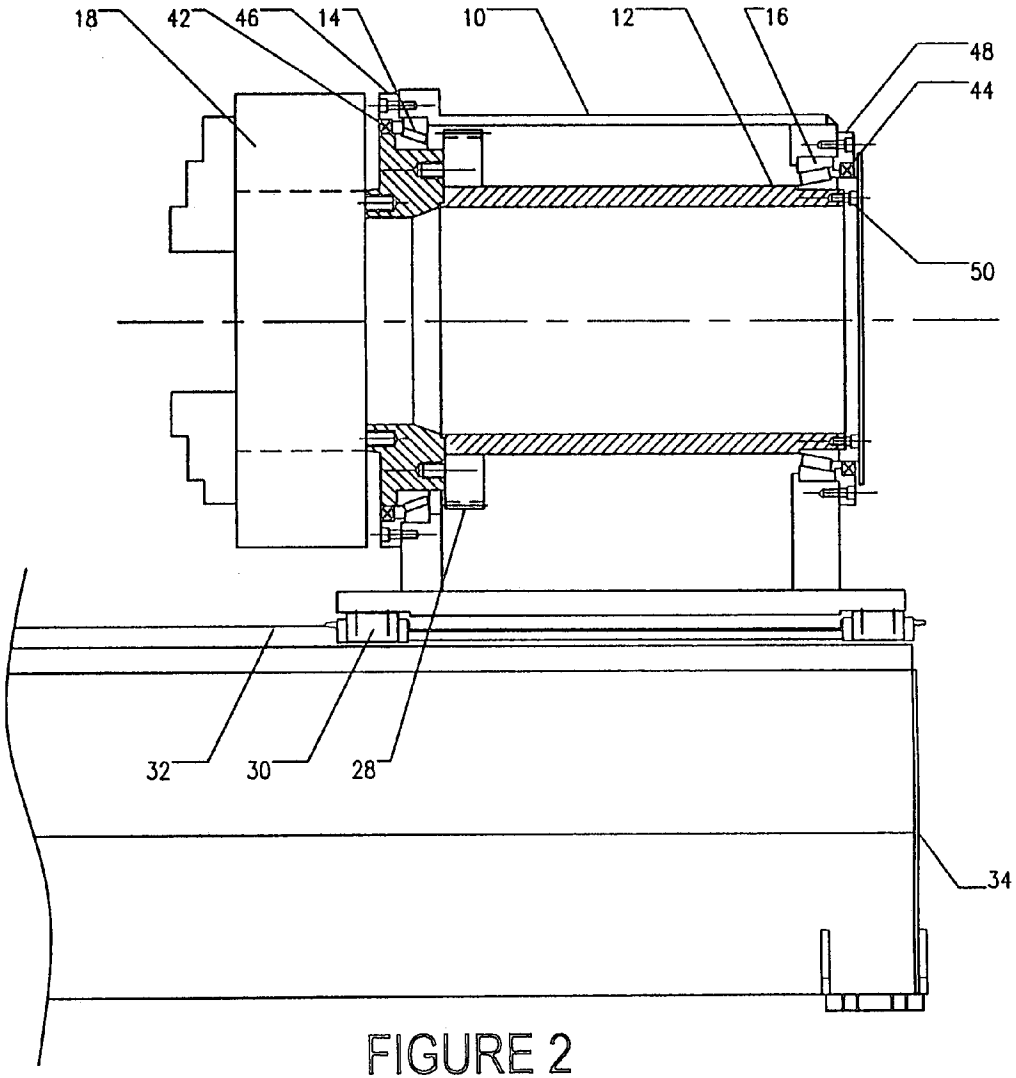
FIG. 2 is a side sectional view of the head stock assembly for feeding and rotating a tubular member.

The head stock assembly is best illustrated in FIG. 2 and has the purpose of feeding and rotating the slotted tubular member through the subsequent assemblies. The head stock assembly consists of a head stock housing 10 which supports a quill 12 that is held in position by front and rear bearings 14 and 16 which allow the quill 12 to be rotated, A chuck 18, which is bolted to the quill 12, grips the slotted tubular member as it is being rotated.

Figure 3:
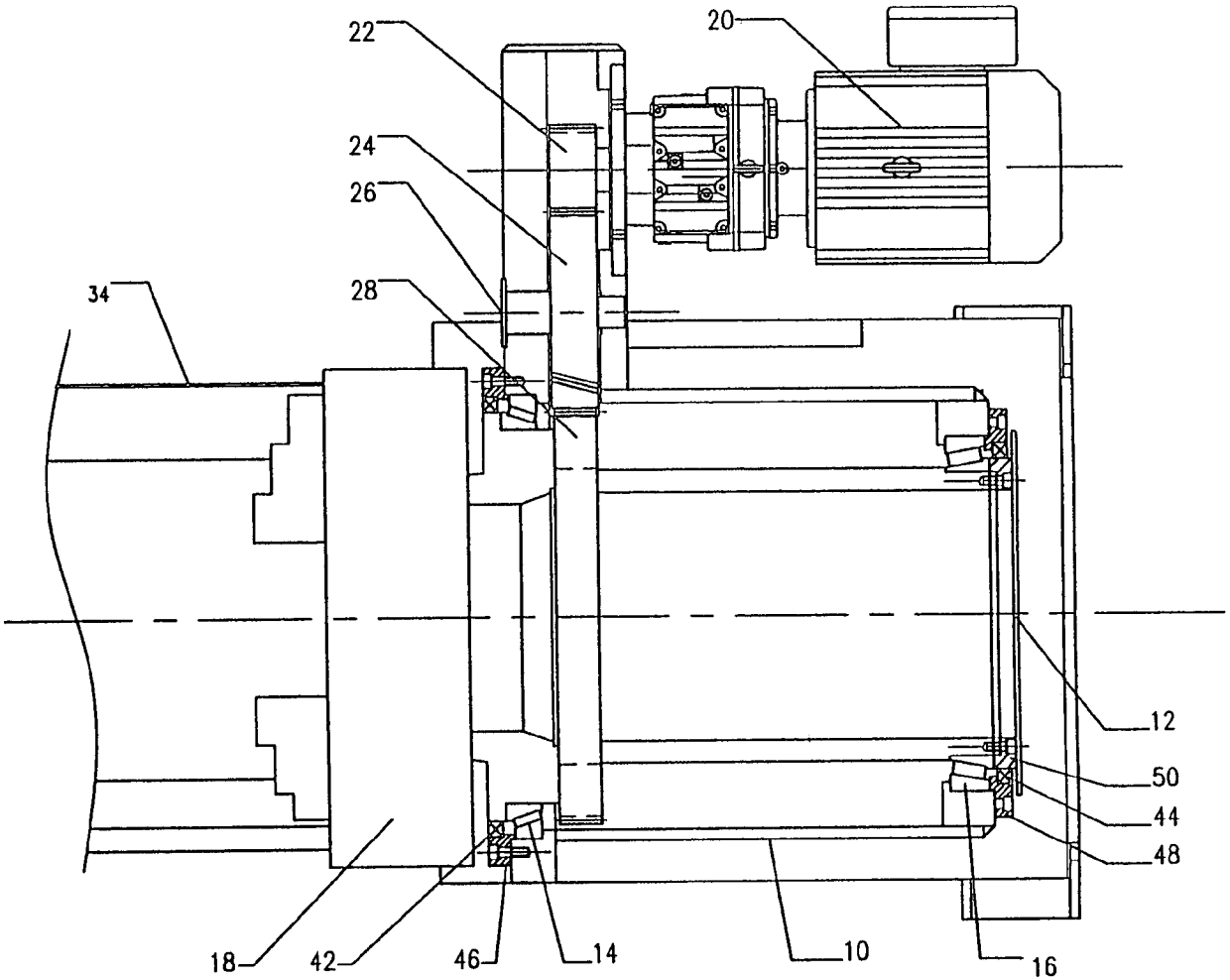
FIG. 3 is a top view of the head stock assembly for feeding and rotating a tubular member showing the head stock drive motors.

As shown in FIG. 3, the quill 12 is driven by a quill drive motor 20 which is geared through a quill drive input pinion 22, an intermediate gear 24 which is held in position by an intermediate gear shaft 26, and a quill gear 28.

As shown in FIG. 2, the head stock housing 10 is equipped with four linear bearing carriages 30 which are attached to the linear bearing guideway 32. The linear bearing guideway 32, in turn is mounted to a base 34, which allows the head stock assembly to travel longitudinally along the base.

Figure 4:
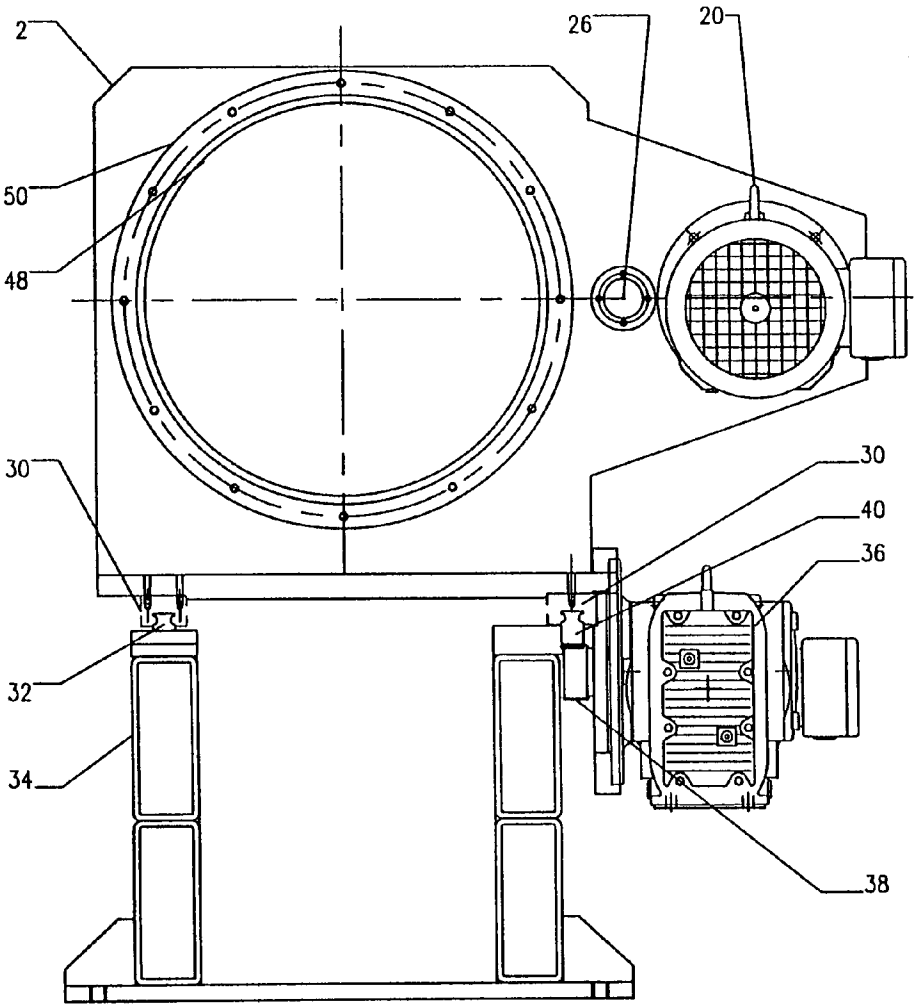
FIG. 4 is an end view of the head stock assembly for feeding and rotating a tubular member.

As shown in FIG. 4, the head stock assembly is driven along the base 34 by a rack drive motor 36 having a rack drive pinion 38 which drives along a linear bearing guideway with the rack 40 providing linear movement of the head stock assembly 2 longitudinally along the base 34.

As shown in FIG. 3, as the quill 12 rotates, oil is sealed by front and rear seals 42 and 44 housed in front and back seal retainers 46 and 48. A rear bearing retainer 50 is also used to hold and retain the bearings and seals onto the quill 12.

Alternative methods to drive the head stock assembly along the base may be used. For example ball screw and nut embodiments or threaded screw and nut embodiments wherein a nut is attached to the base of the head stock housing 10 and longitudinal movement is effected by a screw. As another alternative, a timing belt or chain may be used to drive the quill from the motor. As another alternative method, a hydraulic cylinder attached to the base of the head stock housing 10 can be used to push or pull the head stock housing longitudinally along the length of the slotted tubular member.

Figure 5:
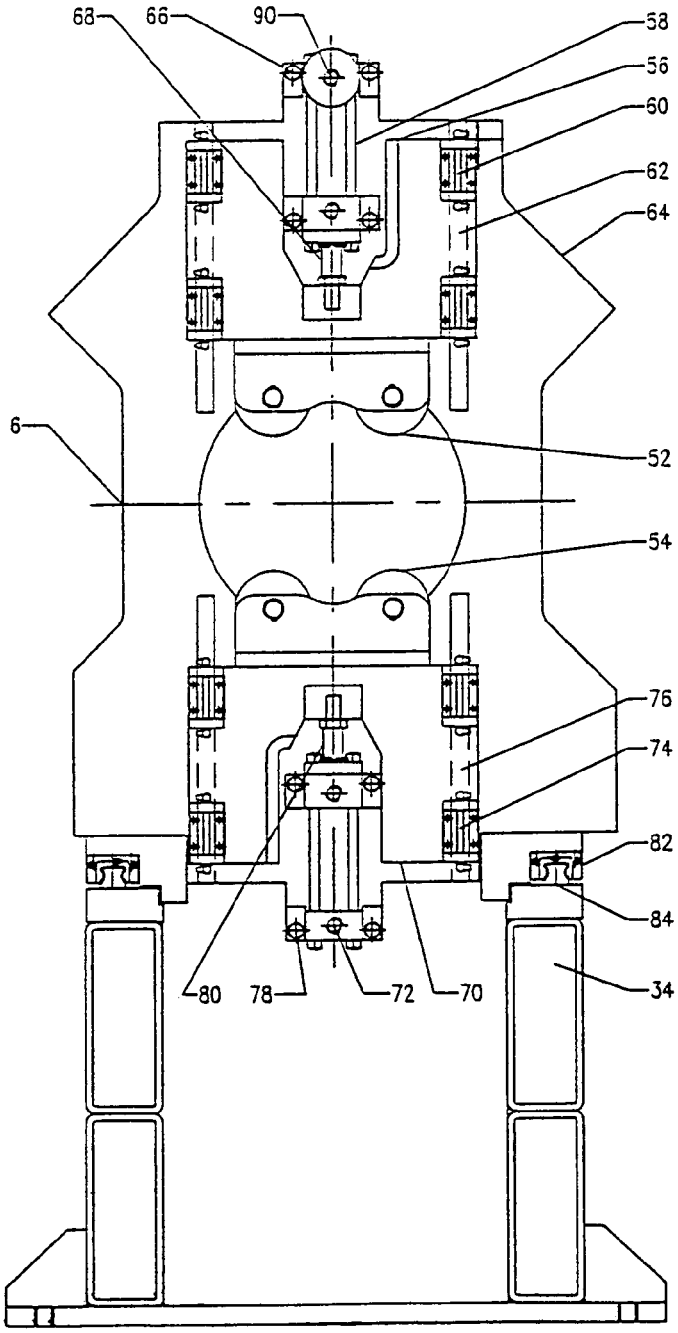
FIG. 5 is and end view of the clamp roller assembly which positions the tubular member adjacent the seaming roller assembly taken along line—5—5—of FIG. 1.

The clamp roller assembly is best illustrated in FIG. 5 and has a purpose of supporting the slotted tubular member 4 and applying force to the slotted tubular member 4 wherein the force applied holds said tubular member 4 centered in place as it enters the seaming assembly 8.

The clamp roller assembly 6 includes two upper floating rollers 52 and two lower rigid rollers 54. The floating rollers 52 are housed in a floating roller holder 56 that allows vertical movement of said upper rollers 52 by means of floating roller hydraulic cylinder 58.

The floating roller holder 56 is equipped with four floating roller linear bearing carriages 60, which are attached to two floating roller linear bearing guideways 62 bolted to the roller stand 64. This allows the floating roller holder 56 to be held in place and guided while being activated by the floating roller hydraulic cylinder 58. The floating roller hydraulic cylinder 58 is mounted by bolts 66 to the roller stand 64. The hydraulic cylinder rod end 68, which is threaded, is attached to the floating roller holder 56.

The lower rigid rollers 54 are housed in a rigid roller holder 70 which allows vertical movement of the lower rigid rollers 54 by means of a Temposonics® controlled rigid roller hydraulic cylinder 72 (Temposonics® is a trade mark of MTS® Systems Corporation, Minnesota, U.S.A. for magnetostrictive linear position sensors).

The rigid roller holder 70 is equipped with four rigid roller linear bearing carriages 74, which are attached to two rigid roller linear bearing guideways 76 bolted to the roller stand 64. This allows the rigid roller holder 70 to be held in place and guided while being activated by a Temposonics® controlled rigid roller hydraulic cylinder 72. The Temposonics® controlled rigid roller hydraulic cylinder 72 is mounted by bolts 78 to the roller stand 64. The hydraulic cylinder rod end 80, which is threaded, is attached to the rigid roller holder 70.

In a preferred embodiment, roller stand 64 is mounted on base 34 by four roller stand linear bearing carriages 82, which are attached to two roller stand linear bearing guideways 84 fixed to the base 34. This allows longitudinal movement of the roller stand 64 relative to the base 34. Alternatively the roller stand can be fixed to the base by bolts without the intervening structure of roller stand linear bearing carriages or roller stand linear bearing guideways.

The clamp roller assembly 6 supports and centers the slotted tubular member thus allowing the seaming rollers to act with equal force on the slotted tubular member in order to bring the slots to plastic deformation. A minimal amount of pressure, depending on the yield strength of the slotted tubular member, acting on the piston area of the cylinders 58 and 72 is enough to give slot openings with a width tolerance of plus or minus 0.0005" (0.0127 mm) during plastic deformation, depending on the initial physical characteristics of the slotted tubular member 4.

Figure 13:
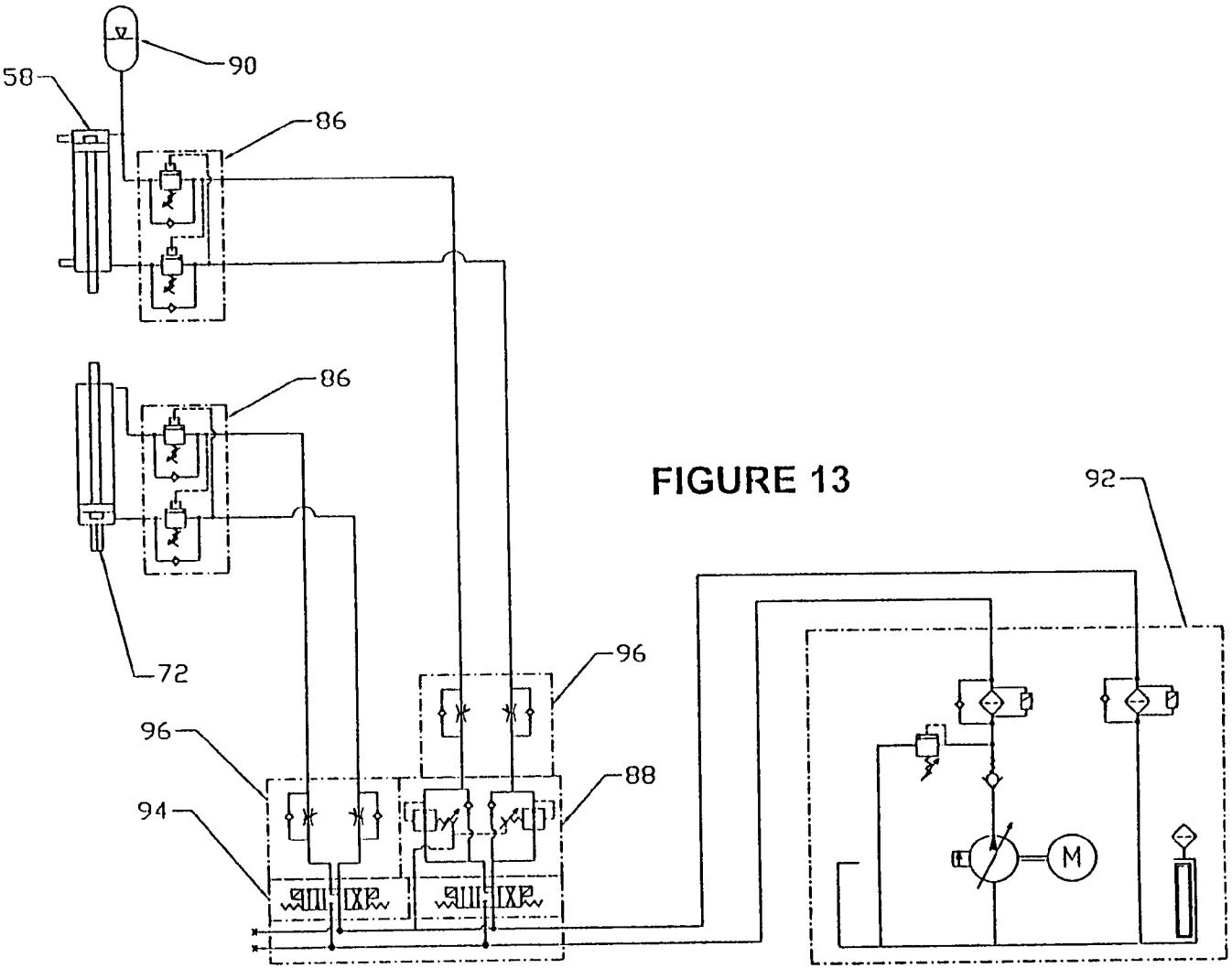
FIG. 13 is a schematic view of the clamp roller assembly as connected to the hydraulic control system.

As depicted schematically in FIG. 13, the Temposonics® controlled rigid roller hydraulic cylinder 72 brings the tubular member 4 into a center position. The tubular member is held centered in the chuck 18 and clamp rollers 52 and 54, which allows equal forces to be applied during the seaming process, while the tubular member 4 is rotated in an axial direction through the machine. The Temposonics® controlled rigid roller hydraulic cylinder 72 is held in place by a counterbalance valve 86, which maintains the cylinder position at all times until smooth lowering is required to clear the tubular member 4 during exiting or entering the machine.

The floating roller holder hydraulic cylinder 58 has a dual purpose. Firstly, it clamps the tubular member 4 with the upper rollers 52. Secondly, it stabilizes the tubular member 4 with minimum force to minimize harmonic vibrations. As depicted schematically in FIG. 13, the floating roller holder hydraulic cylinder 58 is positioned by a pressure-reducing valve 88 to hold the rollers 52 in contact with the tubular member 4 with the purpose of providing dampening of the harmonic vibration, while allowing the tubular member 4 to extend and move longitudinally and rotationally through the rollers. The tubular member 4 may be elliptical in shape and out of round by as much as 0.125" (3.175 mm). If the rollers 52 were held firm (as in a lathe fixture), pressure spikes would occur in the rollers 52 causing some of the slots to plastically deform prematurely as the tubular member 4 is rotated. To eliminate this problem, a floating roller hydraulic cylinder accumulator 90 is positioned above the floating roller holder hydraulic cylinder 58, between the floating roller hydraulic cylinder 58 and a counterbalance valve 86. This allows pressure spikes of the hydraulic fluid to be absorbed into the floating roller hydraulic cylinder accumulator 90 as the elliptical tubular member 4 forces the floating roller 52 to move up and down, eliminating damaging roller forces while maintaining an even constant pressure on the tubular member 4. Counter balance valve 86 acts to lock the pressure within the respective hydraulic cylinders 58 and 72.

As shown schematically in FIG. 13, the direction of the hydraulic oil flow from the hydraulic power unit 92 is controlled by floating roller directional valves 94. The volume of hydraulic fluid added or removed to the hydraulic cylinders 58 and 72 is in turn controlled by a flow control valves 96.

Figure 6:
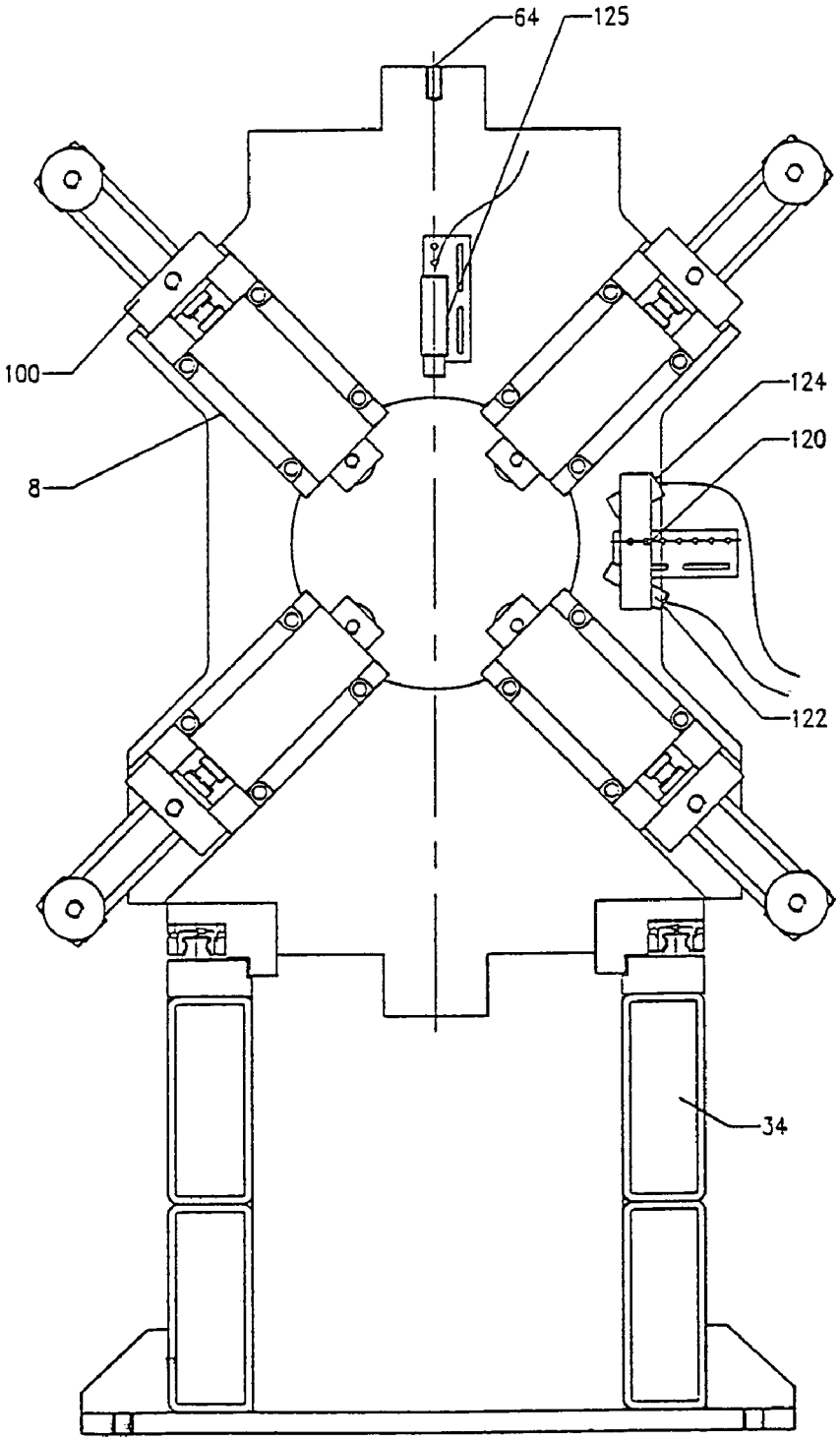
FIG. 6 is an end view of the seaming roller assembly taken along line—6—6—of FIG. 1.

The seaming roller assembly 8 is best illustrated in FIG. 6. It is desirable to have the force applied by seaming rollers 98 onto the slotted tubular member 4 be equal and constant. Any vibration caused by the slots or an elliptical tubular member 4 will introduce pressure spikes into the system, causing uneven slot width. As mentioned above, a minimal amount of change in force, depending on the yield strength of the slotted tubular member 4, can vary slot width by as much as 0.0005" (0.0127 mm) or will close the slots at the slot ends, all of which will result in uneven slot width along the length of the slot.

Figure 7:
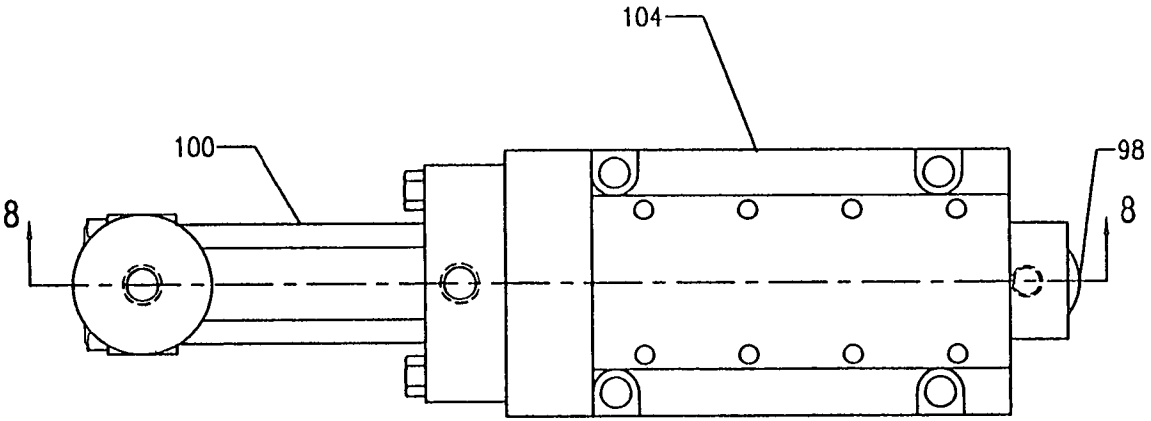
FIG. 7 is an end view of one of the seaming roller assembly of FIG. 6.
Figure 8:
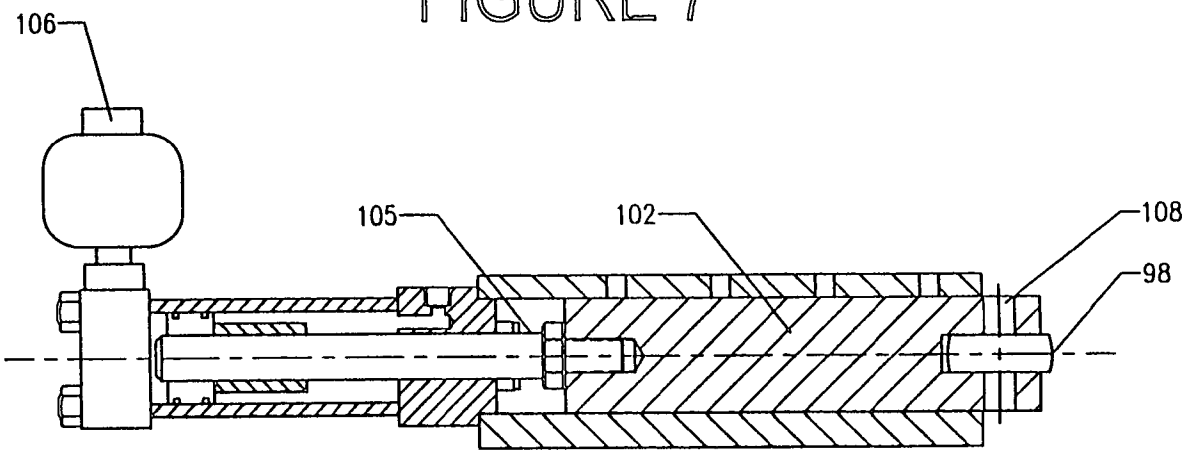
FIG. 8 is a sectional view of the seaming roller assembly taken along line—8—8—of FIG. 7.

With reference to FIGS. 7 and 8, the seaming roller hydraulic cylinders 100 which operate the seaming rollers 98 are shown to be threaded into a guided roller holder 102, for longitudinal movement in a roller holder channel 104. This takes up all side force placed on the cylinder rods 105 by the rotation of the slotted tubular member 4. As shown in FIG. 6, the seaming roller hydraulic cylinders 100 are opposing each other at 180°, plumbed in parallel to each other. This allows pressure to remain constant between the seaming roller hydraulic cylinders 100 resulting in equal opposing forces (180° apart) being applied to the slotted tubular member 4 through its elliptical pattern. To further reduce pressure fluctuations a seaming roller accumulator 106 is placed on each seaming roller hydraulic cylinder 100. The accumulator 106 reduces pressure pulsations caused by the movement of the seaming rollers 98 over the slots in the slotted tubular member 4 or caused by elliptical variations in the slotted tubular member 4. A constant even hydraulic pressure is maintained as pressure pulsations are compensated by compressing $N_2$ within the seaming roller accumulator 106. Seaming roller 98 is attached to the guided roller holder 102 by a seaming roller shaft 108. The seaming roller holder channel 104 is bolted to the roller stand 64.

The tubular member is formed with a plurality of slots or openings of any shape. Typically, a plurality of slots are formed oriented longitudinally (i.e., along the longitudinal axis of the tubular member). However, the slots can be formed at virtually any angle, including perpendicular to the longitudinal axis fo the pipe. Slots may be oriented in a number of patterns such as single (inline, staggered, or spiral) and multiple (inline, staggered or spiral). The staggered pattern places each adjacent row of slots off center to the row previously cut. The inline pattern places each adjacent row of slots even with the row previously cut. The spiral pattern arranges the slots circumferentially in a helical pattern along the longitudinal axis of the tubular member. Typically the plurality of longitudinal slots of a slotted tubular member 4 are cut to have equal lengths, but unequal lengths can be accommodated by the present invention. The slots may also be cut at an angle to the longitudinal axis of the pipe. Generally a metal slotted tubular member is formed with a plurality of longitudinal slots cut circumferentially around the member that range from 0.203 mm to 6.350 mm in width but may deviate from this range depending on the application for the slots. Typically the slots are cut less than 3.175 mm in width for oil and gas purposes.

The plurality of slots or openings of the slotted tubular member 4 are seamed so that the profile of a given slot 9 has a width that is generally consistent throughout the length of the slot profile. The actual variance in the width tolerance of the final slot profile from a desired end slot width is dependent on the initial characteristics of the slotted tubular member 4. Such initial characteristics may include the surface finish of the slotted tubular member 4 or any slot preparations performed on the tubular member prior to subjecting the slotted tubular member 4, to the seaming roller assembly 8.

Seaming of the slot width is dependent on contact between the seaming rollers 98 and the periphery edges of a given slot 9. The rougher the outer surface of a slotted tubular member 4, the rougher the periphery edges of a given slot 9. As the roughness increases the number of peaks and valleys on the peripheral edge of a slot increases and, as such, the surface area of the slotted tubular member in contact with the seaming rollers 98 decreases. This decrease in contact surface between the seaming rollers 98 and the peripheral edges of the slot 9, reduces the ability of the seaming rollers to plastically deform the slot. For example, a surface finish with an roughness average of 6.3 μm (250 μin.) or greater, generally results in a slot 9 having a profile with a width tolerance that throughout the length of the slot profile, varies no more than about +/−0.0381 mm from the desired end slot width. A surface finish with a roughness average of 1.6 μm (63 μin.) or smaller, generally results in a slot 9 having a profile with a width tolerance that throughout the length of the slot profile, varies no more than about +/−0.0127 mm from the desired end-slot width. In some circumstances a surface finish with a roughness average of 1.6 μm or smaller, or slotted tubular members that have been ground finished (roughness average of 1.6–0.10 μm), can result in a slot 9 having a profile with a width tolerance that throughout the length of the slot profile, varies no more than about +/−0.00762 mm from the desired end slot width. Width tolerances as low as +/−0.00762 mm from the desired end slot width, are generally possible when slot preparations have been performed on the slotted tubular member 4 prior to subjecting the member to the seaming roller assembly 8. Such slot preparations on the slotted tubular member 4 may include cleaning the slots with a wire brush or solvents or polishing, lapping or superfinishing the slotted tubular member 4.

In an alternate embodiment, the seaming rollers 98 can be operated by pneumatic cylinders (not shown) in place of seaming roller hydraulic cylinders 100 and seaming roller accumulator 106.

Figure 11:
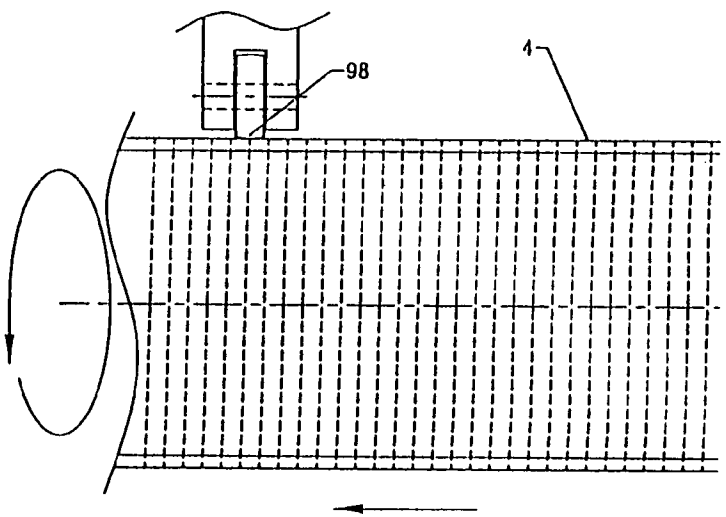
FIG. 11 is a schematic side view of the helical sweep path taken by the seaming roller around the slotted tubular member.
Figure 9:
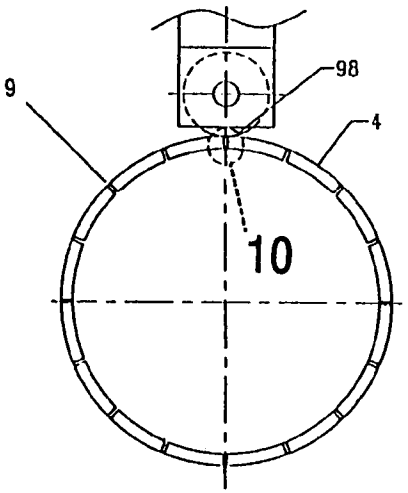
FIG. 9 is a schematic sectional view of one of the seaming rollers over a slot in slotted tubular member.
Figure 10:
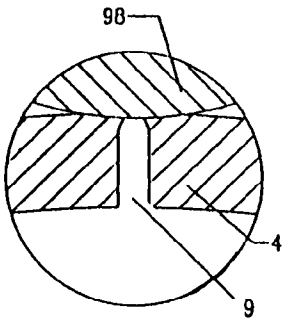
FIG. 10 is a schematic sectional view showing the detail of the circle 10 in FIG. 9.
Figure 12:
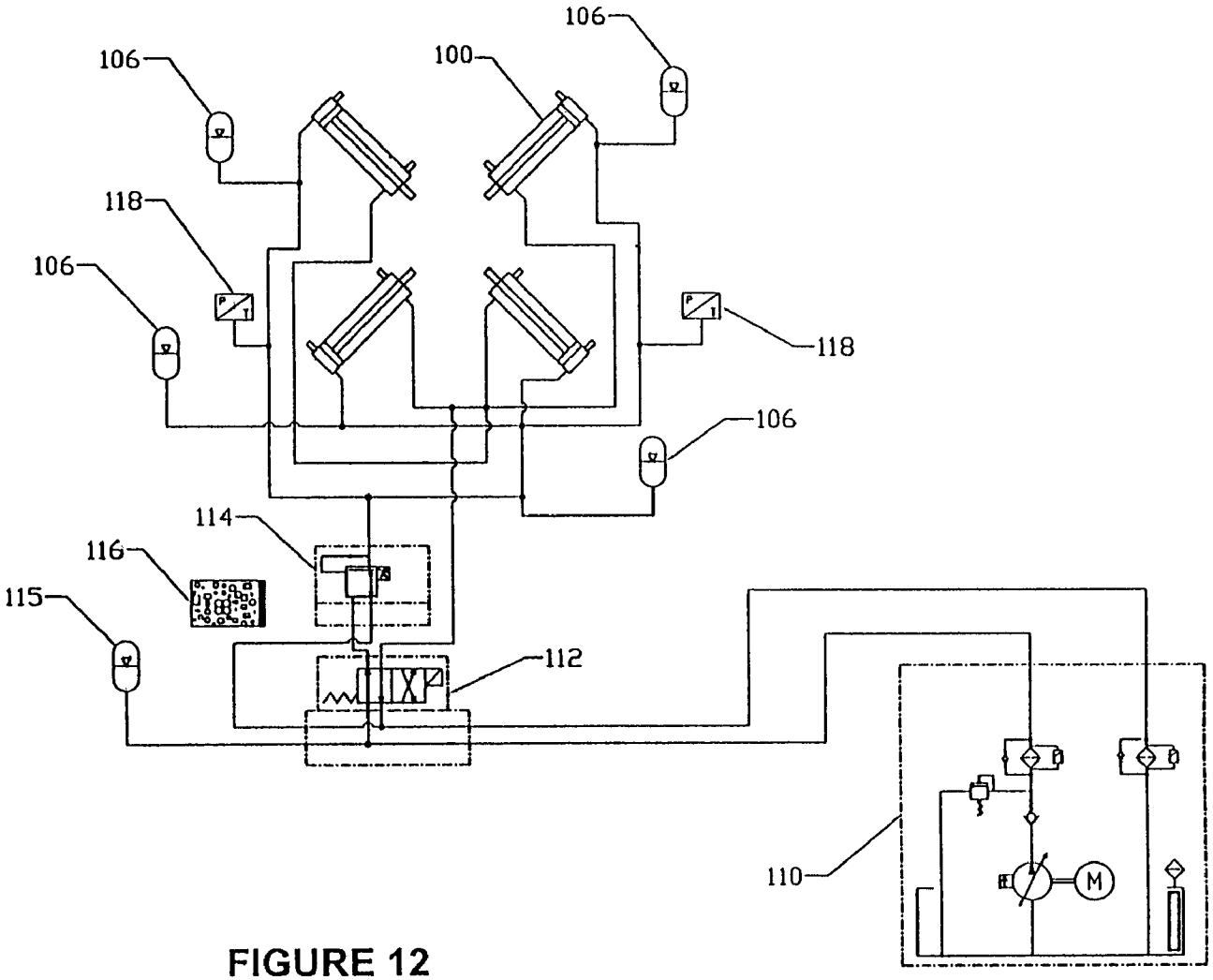
FIG. 12 is a schematic view of the seaming roller assembly as connected to the hydraulic control system.
Figure 14A:
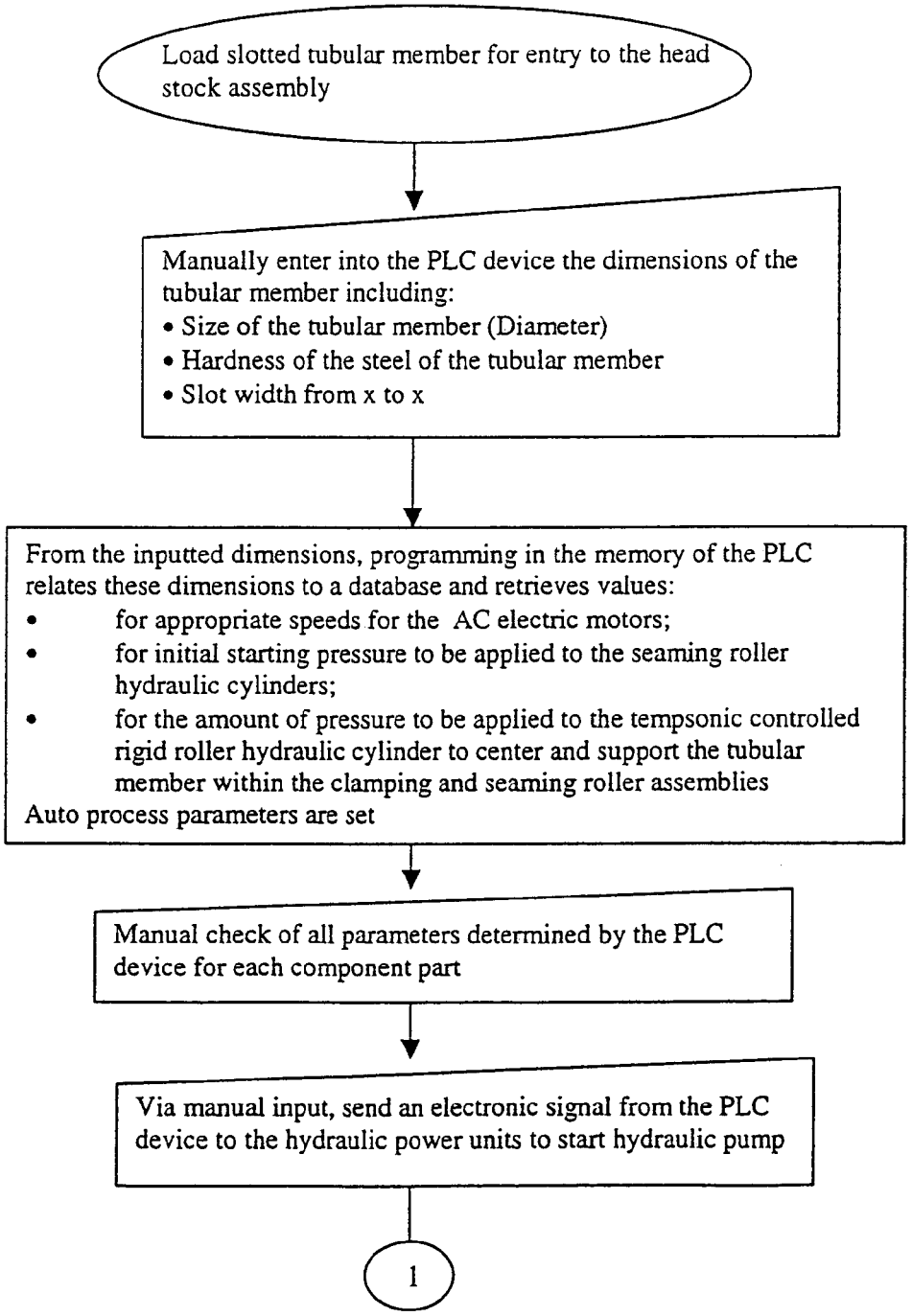
FIGS. 14A and 14B provide a schematic flow chart overviewing the Programmable Logic Control (PLC) of the present invention.
Figure 14B:
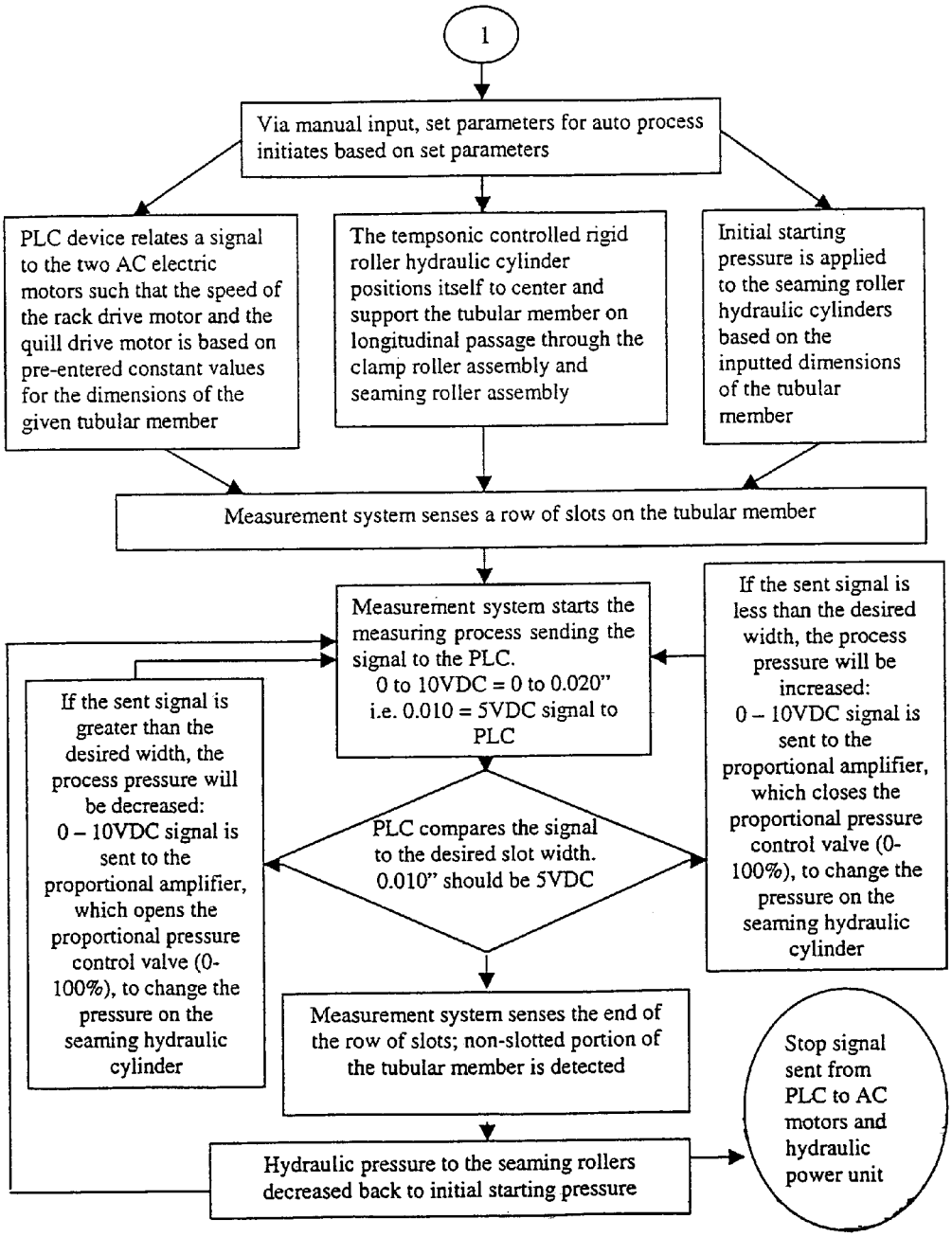

FIGS. 9, 10 and 11 show schematic detail of the track followed by seaming roller 98 as it traverses the longitudinal axis of the slot 9. FIG. 10 shows the slot reduction by the seaming roller 98. As schematically shown in FIG. 12, a constant pressure is supplied from seaming roller hydraulic power unit 110 to a seaming roller directional valve 112 and to a proportional pressure control valve 114. A nitrogen accumulator 115 aids in the constant pressure and flow of the system. To control the precise pressure to the seaming roller hydraulic cylinders 100, a signal is sent from a proportional amplifier 116 to a proportional pressure control valve 114, which incorporates a pressure control spool (not shown) with a pressure sensing piston (not shown) to sense downstream pressure (not shown). The proportional pressure control valve 114 allows the hydraulic pressure to be increased or decreased in the seaming roller hydraulic cylinders 100, resulting in a respective increase or decrease in the force applied to the slotted tubular member 4 from the seaming rollers 98. As shown in FIG. 12, pressure to the seaming roller hydraulic cylinder 100 is verified by a pressure transducer 118 by sending a signal to a Programmable Logic Controller (PLC) (not shown). PLC devices are well known in the art. FIGS. 14A and 14B provide a flow chart of the operational PLC control for this invention to ensure that appropriate pressure is applied to the seaming roller hydraulic cylinders 100.

The electronic control over seaming the tubular member 4 includes a laser detection assembly 120 and the PLC.

As shown in FIG. 6, the laser detection assembly 120 includes a laser 122 and a laser detector 124. The laser detector is preferably a photo detector, which generates an analog signal proportional to the reflected laser signal. Thus, when a solid section of the tubular member 4 is encountered, a high percentage of the laser beam is reflected to the detector. When a slot 9 is encountered, a large portion of the beam falls into the slot 9 and is not reflected. By knowing the rotational speed of the tubular member 4, the diameter of the tubular member, and the sampling speed of the voltage measured on the detector, it is possible to calculate the width of the slot 9 in real time by analyzing the sampled analog voltage collected from the detector 124.

Figure 15:
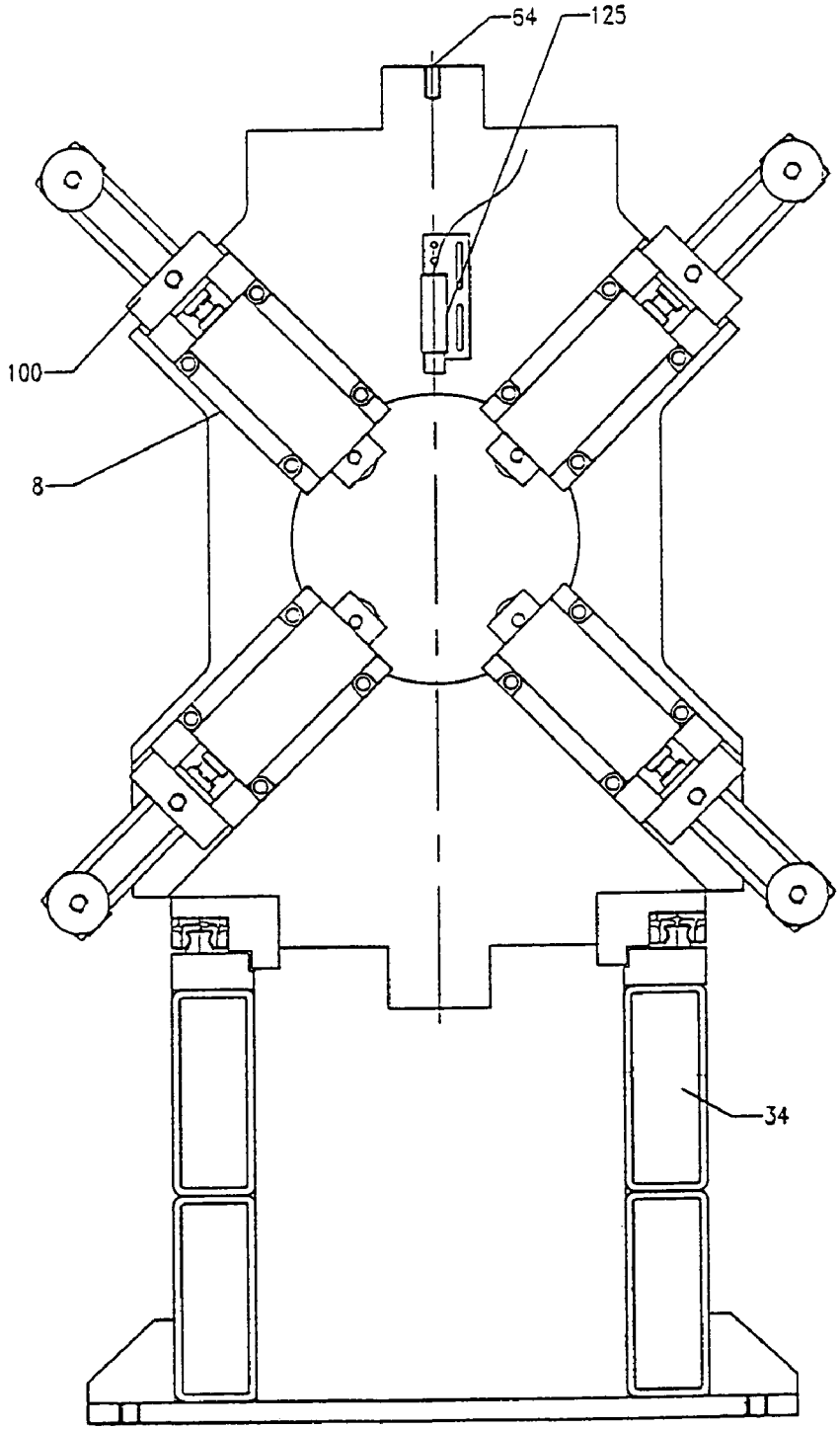
FIG. 15 is an end view of the seaming roller assembly from the perspective of view—6—6—of FIG. 1 showing an optic means or optics for slot width detection as an alternate embodiment.

Alternatives to laser detection may be used. For example an optic system in place of the laser detection assembly of the preferred embodiment may be employed. In an alternative embodiment, as shown in FIG. 15, an optic system may incorporate an optic detectors 125 to detect the initial width of the plurality of slots. In a preferred embodiment the optic detectors 125 comprises a digital camera wherein the digital camera is positioned to measure the slot width in pixels so as to generate a pixilated signal proportional to the width of the slot 9. The pixilated signal is then related to a PLC device (not shown) which compares the pixilated signal with the desired pixilated signal of a set value indicative of a desired end slot width. The PLC thus generates a correction signal proportional to the difference between the pixilated signal and the set value, which is relayed to the hydraulic or pneumatic cylinders so as to vary the force applied by the seaming roller to the plurality of slots in response to the correction signal.

In a preferred embodiment the final width of each of the plurality of slots is measured to ensure quality control. The laser detection assembly 120 as shown in FIG. 6, or the optic detectors 125 as shown in FIG. 15, generates a final width signal proportional to the detected final width, and relays this final width signal to a PLC (not shown). The PLC compares the final width signal to the set value indicative of the desired end slot width to provide a statistical representation of any variance between the two width values. In a preferred embodiment, each opening has a profile with a width tolerance that varies no more than +/−0.0127 mm from the desired end slot width throughout the length of the slot profile, depending on the initial characteristics of the slotted tubular member 4.

In a preferred embodiment the width of each of the plurality of slots is continually measured and detected, relayed to the PLC, compared to a set value indicative of a desired end slot width, and varied through varying the force applied by the seaming roller to a given slot 9 to ensure that each opening has a profile with a width that is generally consistent. In a preferred embodiment an opening with a profile that is generally consistent has a width tolerance that varies no more than +/−0.0127 mm from the desired end slot width throughout the length of the slot profile, depending on the initial characteristics of the slotted tubular member 4.

To demonstrate the calculation of reduced slot width using the laser detection apparatus the following non-limiting sample calculation is provided. A section of the slotted tubular member 4 is positioned beneath the laser detection apparatus 120, in which the rotational speed of the section of the slotted tubular member 4 is 60 rpm, the data acquisition sampling speed is 100 kHz and the assumed diameter of the section of the slotted tubular member is 7" (17.7800 cm). Based on these input variables the circumference of the pipe is calculated to be approximately 21.9911" (55.8574 cm) which in turn provides a calculated inches/sample of 0.000219911"/sample (0.0006 cm/sample) as follows:

$$21.9911''/100000 \text{ samples} = 0.000219911''/\text{sample} \quad (0.0006 \text{ cm/sample}).$$

The width of the slot 9 is measured at 50.25 samples wide (slot width determined by measurement of pulse width), resulting in a calculated width of the slot 9 of:

$$\text{Inches/sample} \times \text{width of slot (in samples)} = 50.25 \text{ samples} \times 0.000219911''/\text{sample} = 0.01105'' (0.281 \text{ mm})$$

Therefore the detected width of the measured slot 9 is 0.01105" (0.0281 cm) subject to application of a calibration factor, which eliminates any slight inaccuracies introduced in the slot measurement process.

As shown in FIG. 6, two identical laser detector assemblies 120 are mounted on each roller sand 201. The first laser assembly 120 is positioned over a portion of the tubular member 4 that is being processed by the seaming rollers 98. The detector's processed signal is used to adjust the force of the seaming rollers 98 as applied to the slotted tubular member 4 in order to control and manipulate the final slot width. The second laser assembly is positioned immediately after the last seaming roller 98 and its signal is designated as the finished slot width and is recorded in a database. When processing is complete, slot width information for the entire section of the slotted tubular member 4 examined undergoes statistical analysis in order to provide a strict quality control output.

In a preferred embodiment the laser may be a StockerYale Lasiris™ MFL-670-5-1-65 with 5 mW line generator producing a 13 μm×1 mm line at 670 nm and the detectors may be a Edmund Optics silicon detector 54-034 with 16.4 $mm^2$ active area, operation in unbiased (photovoltaic) mode with the voltage measured across a 100 k ohm resistor. In measuring the input from the detectors a National Instruments PCI-6070E data acquisition card may be used which has a 1.25 MS/s maximum sampling speed with 12-bit accuracy. An analog voltage proportional to the amount of reflected laser radiation is produced. The laser and the detector assembly are kept at a constant distance (focal length) from the section of the slotted tubular member 4 being measured to ensure accuracy and reduce errors in the final measurement of slot width. Alternatives to these lasers, detectors and data cards may be used and are well known in the art.

On detection by the laser detection assembly, an analog signal proportional to the reflected signal is produced and then fed to a Programmable Logic Control (PLC) device. The PLC controls the mechanical motion of the seaming rollers 98 through two Head stock drive motors (quill drive motor 20 and rack drive motor 36 as shown in FIG. 3). The program in the memory of the PLC relates inputted data on the width of a given slotted tubular member to a database that then relays signals to the head stock assembly, the clamp roller assembly and the seaming roller assembly. Signals sent to the bead stock assembly 2 are directed to the two head stock drive motors such that the speed of the rack drive motor 36 and the quill drive motor 20 is based on pre-entered constant values for the dimensions of the given tubular member. The program in the memory of the PLC calculates the speed that the head stock assembly 2 will need to move longitudinally as along the linear bearing guideway in order to maintain the axial motions of the head stock down the entire length of the tubular member through an industrial communication platform (Device-Net).

Signals sent to the clamp roller assembly 6 serve to manipulate the Temposonics® controlled rigid roller hydraulic cylinder 72 such that the pressure applied to this cylinder locates the rigid rollers 54 so as to center and support the slotted tubular member for entry into the seaming roller assembly 8. The exact positioning of the tubular member 4 is important to ensure that equal forces are applied to the tubular member 4 during the seaming process. Signals sent to the seaming roller assembly 8 from the PLC serve to manipulate the seaming roller hydraulic cylinders 100 that in turn vary the force applied by the seaming rollers onto the slotted tubular member 4.

As schematically outlined in FIG. 14, the PLC device is activated on loading a slotted tubular member 4 for entry to the head stock assembly 2 and on entering the dimensions of said tubular member 4 including the diameter of the tubular member 4, the hardness of the steel of the tubular member 4 and the desired end slot width from x to x, into the PLC device. A program within the memory of the PLC then relates the inputted dimensions against a database in order to create a set of parameters for auto processing. Included in this set of parameters are the appropriate speeds for the Head stock drive motors (rack drive motor 36 and quill drive motor 20), the initial starting pressure to be applied to the seaming roller hydraulic cylinders 100 and the amount of pressure to be applied to the Temposonics® controlled rigid roller hydraulic cylinder 72. All these values are generated based on calculations performed by the PLC, which take into account the inputted dimensions of the given tubular member compared against retrieved information from a database. After checking the values generated by the PLC manually, the PLC directs a signal to the hydraulic power units 110 and 92 (Seaming roller hydraulic power unit and floating roller hydraulic power unit respectively) to start the hydraulic pump (not shown). The auto process is then initiated via a manual push button control (not shown).

On initiation, the PLC sends signals to the multiple assemblies 2, 6, 8 to perform three functions: a signal is related to the Head stock drive motors (rack drive motor 36 and quill drive motor 20) to correlate the speed of the motors with the dimensions inputted for the tubular member; a signal is sent to the Temposonics® controlled rigid roller hydraulic cylinder to position the rigid rollers 72 so as to center and support the given tubular member; and a signal is sent to proportional amplifier 116 to set the initial starting pressure to be applied to the seaming roller hydraulic cylinders 100 that correlates with the dimensions of the given tubular member. The PLC continuously performs a self check of the rotational speed and head stock assembly motion using encoders built into the rack drive motor 36 and quill drive motor 20. The encoders are pulse generators that send a signal back to the PLC to the degree of 1024 pulses/revolution.

For the process control the PLC receives an analog signal from the laser system indicating the width of the slot 9. The PLC then processes this information to decipher the appropriate amount of analog output signal and the reaction time to send to the hydraulic proportional pressure control valve 114, through the proportional amplifier 116. The proportional amplifier 116 exerts the seaming force into the slotted tubular member 4. This process is performed at each seaming roller assembly 204.

When the PLC device senses a row of slots on the slotted tubular member via a measurement system (i.e., laser detection assembly or digital camera in alternate embodiment), a measuring process starts that relates the width of a slot 9 to a voltage value. For example, as shown schematically in FIG. 14, a 0.010" slot width may correspond to a 5 VDC signal being sent to the PLC. The PLC compares this signal to the desired slot width also inputted into the computer program. If the signal sent corresponds to greater than the desired slot width, the PLC decreases the process pressure (for example 0 to 10 VDC) by sending a signal to the proportional amplifier (116 in FIG. 12), which opens the proportional pressure control valve 114 (0–100%). The opening of the proportional pressure control valve 114 changes the hydraulic pressure applied to the seaming roller hydraulic cylinder 100. If the signal sent is less than the desired width, the PLC increases the process pressure (for example 0 to 10 VDC) by sending a signal to the proportional amplifier (116 in FIG. 12), which closes the proportional pressure control valve 114 (0–100%). The closing of the proportional pressure control valve 114 changes the hydraulic pressure applied to the seaming roller hydraulic cylinder 100. After the change in hydraulic pressure, slot width is again measured via the measuring process in a feedback loop as illustrated in FIG. 14 until the desired slot width is obtained.

The hydraulic pressure at each seaming roller hydraulic cylinder, the actual chuck rotation 18, the head stock assembly 2 motion longitudinally as along the linear bearing guideway 32, the slot width at each seaming roller 98 and the output hydraulic pressure signal can all be monitored at the operator console on the touch screen (not shown).

When the measurement system (ex., laser detection assembly in preferred embodiment) senses the end of the row of slots on the tubular member, the PLC decreases the hydraulic pressure to the seaming rollers 98 by sending a signal to the proportional amplifier. If the end of a tubular member is detected by the measurement system, then a stop signal is sent from the PLC to the Head stock drive motors (the quill drive motor 20 and the rack drive motor 36) and the hydraulic power unit. If another region of slots is detected by the measurement system then the measurement process begins again to compare and adjust the width of the slot 9 being measured against the desired slot width entered.

All publications mentioned in this specification are indicative of the level of skill in the art of the invention. All publications are herein incorporated by reference to the same extent as if each publication was specifically and individually indicated to be incorporated by reference. The terms and expressions used are, unless otherwise defined herein, used as terms of description and not limitation. There is no intention, in using such terms and expressions, of excluding equivalents of the features illustrated and described it being recognized that the scope of the invention is defined and limited by the claims which follow.

We claim:

1. An apparatus for reducing the width of a plurality of slots or other openings spaced circumferentially around a slotted tubular member comprising:

(a) a seaming roller positioned to contact the outer surface of the slotted tubular member for transverse movement relative to the longitudinal axis of the slotted tubular member, and adapted to apply a force onto the slotted tubular member so as to reduce the slot width to a final slot width;

(b) a first detector adjacent the seaming roller for detecting an initial width of the plurality of slots and generating a detection signal proportional to the detected initial width;

(c) a comparator connected to the first detector for comparing the detected initial width to a set value indicative of a desired end slot width and to generating a correction signal proportional to the difference;

(d) an adjustor connected to the seaming roller and the comparator, for adjusting the force applied by the seaming roller to the plurality of slots in response to the correction signal.

2. The apparatus of claim 1, further comprising longitudinally feeding and axially rotating the slotted tubular member through the seaming roller.

3. The apparatus of claim 2, wherein the adjustor includes a hydraulic cylinder to apply the force to the seaming roller.

4. The apparatus of claim 2, wherein the adjustor includes a pneumatic cylinder to apply the force to the seaming roller.

5. The apparatus of claim 3, wherein the slotted tubular member is formed with a plurality of longitudinal slots and wherein the force applied by the seaming roller as the seaming roller moves across each of the plurality of slots is maintained with an accumulator attached to the hydraulic cylinder.

6. The apparatus of claim 5, further comprising a plurality of seaming rollers located circumferentially around the slotted tubular member.

7. The apparatus of claim 6, further comprising clamps adjacent to the seaming roller for clamping the slotted tubular member so as to hold the slotted tubular member centered relative to its longitudinal axis as it moves through the seaming roller.

8. The apparatus of claim 7, wherein the clamps includes diametrically opposed clamping rollers to clamp the tubular member, one of said clamping rollers being adapted to hold a fixed position and the other being adapted to apply a dampening clamping force to compensate for off centre movement of the slotted tubular member.

9. The apparatus of claim 5, which further comprises a second detector adapted to detect the final width of the plurality of slots, to generate a final width signal proportional to the detected final width; and wherein the comparator is adapted to compare the detected final width signal to a set value indicative of the desired end slot width.

10. The apparatus of claim 8, which further comprises a second detector adapted to detect the final width of the plurality of slots, to generate a final width signal proportional to the detected final width; and wherein the comparator is adapted to compare the detected final width signal to a set value indicative of the desired end slot width.

11. The apparatus of claim 8, wherein the clamping roller adapted to hold a fixed position, is connected to a hydraulic cylinder controlled by a magnetostrictive linear position sensor in order to apply a force to hold the fixed position.

12. The apparatus of claim 10, wherein the clamping roller adapted to hold a fixed position, is connected to a hydraulic cylinder controlled by a magnetostrictive linear position sensor in order to apply a force to hold the fixed position.

13. The apparatus of claim 11, wherein the clamping roller adapted to apply a dampening clamping force, is connected to a hydraulic cylinder and an accumulator in order to apply a dampened force.

14. The apparatus of claim 12, wherein the clamping roller adapted to apply a dampening clamping force, is connected to a hydraulic cylinder and an accumulator in order to apply a dampened force.

15. The apparatus of claim 14, wherein the clamping rollers are located transverse the longitudinal axis of the slotted tubular member.

16. The apparatus of claim 15, wherein the first or second detector uses optics to detect the width of the plurality of slots.

17. The apparatus of claim 16, wherein optics comprises a camera wherein the camera is positioned to measure the slot width in pixels so as to generate a pixilated signal proportional to the width of the slot.

18. The apparatus of claim 15, wherein the first or second detector comprises a laser and a laser detector, the laser being positioned to direct a laser beam at the plurality of slots, and the laser detector being positioned to receive a reflected laser beam off the slotted tubular member and to generate a signal proportional to the reflected laser beam.

19. The apparatus of claim 18, wherein longitudinally feeding and axially rotating the slotted tubular member includes:

(a) a headstock housing;

(b) a chuck mounted on the headstock housing for receiving and securing the slotted tubular member;

(c) a quill carried by the headstock housing for rotating the slotted tubular member once it is secured by the chuck; and (d) a conveyor for conveying the headstock housing longitudinally relative to the seaming roller.

20. The apparatus of claim 19, wherein the headstock housing is mounted on a track for longitudinal movement relative to the seaming roller.

21. The apparatus of claim 20, wherein the comparator is a programmable logic controller that compares received signals with inputted stored set values.

22. The apparatus of claim 21, wherein the programmable logic controller receives inputted rates of longitudinal and axial movement for the slotted tubular member and provides output signals to directly control the conveyor, chuck and quill.

23. The apparatus of claim 1 further comprising moving the seaming roller and the clamps longitudinally along the slotted tubular member; and axially rotating the slotted tubular member through the seaming roller.

24. The apparatus of claim 1, wherein the slotted tubular member is metal.

25. The apparatus of claim 23, wherein the slotted tubular member is metal.

26. A method of reducing the width of a plurality of longitudinal slots or other openings spaced circumferentially around a slotted tubular member, comprising:

(a) providing at least one seaming roller positioned to contact the outer surface of the slotted tubular member for transverse movement across the plurality of slots;

(b) detecting an initial width of each of the plurality of slots to generate a detection signal proportional to the detected initial dimensions;

(c) comparing the detected initial width of the slots to a set value indicative of a desired end slot width to generate a correction signal proportional to the difference;

(d) applying a downward force onto the slotted tubular member with the at least one seaming roller; and (e) varying the force applied by the at least one seaming roller to the plurality of slots along the slotted tubular member in response to the correction signal.

27. The method of claim 26, further comprising longitudinally feeding and axially rotating the slotted tubular member through the at least one seaming roller.

28. The method of claim 27, further comprising maintaining the force applied by the at least one seaming roller as the seaming roller moves across each of the plurality of slots with an accumulator.

29. The method of claim 28, further comprising clamping the slotted tubular member so as to hold the slotted tubular member centered and to dampen harmonic vibrations as the slotted tubular member moves through the seaming roller.

30. The method of claim 29, further comprising detecting the final width of each of the plurality of slots, generating a final width signal proportional to the detected final width, and comparing the final width signal to the set value indicative of the desired end slot width.

31. The method of claim 30, further comprising moving the at least one seaming roller longitudinally along the length of the slotted tubular member.

32. The method of claim 26, further comprising moving the at least one seaming roller longitudinally along the length of the slotted tubular member.

33. A slotted tubular member comprising: a metal slotted tubular member formed by the method of claim 26 with a plurality of longitudinal slots $\leqq 3.175$ mm in width spaced circumferentially around the member, each slot having been cut and then transversely seamed to have a profile with a width tolerance, that throughout the length of the slot profile, varies no more than +/−0.0127 mm from a desired end slot width.

34. The slotted tubular member of claim 33, wherein each slot is transversely seamed to have a profile with a width tolerance, that throughout the length of the slot profile, varies no more than +/−0.00762 mm from a desired end slot width.

35. A method of reducing the width of a plurality of longitudinal slots or other openings spaced circumferentially around a slotted tubular member, comprising:

(a) providing at least one seaming roller positioned to contact the outer surface of the slotted tubular member for transverse movement across the plurality of slots;

(b) applying a downward force onto the slotted tubular member with the at least one seaming roller; and (c) maintaining the force applied by the at least one seaming roller as the seaming roller moves across each of the plurality of slots with an accumulator.

36. A method of reducing the width of a plurality of longitudinal slots or other openings spaced circumferentially around a slotted tubular member, comprising:

(a) providing at least one seaming roller positioned to contact the outer surface of the slotted tubular member for transverse movement across the plurality of slots;

(b) applying a downward force onto the slotted tubular member with the at least one seaming roller; and (c) longitudinally feeding and axially rotating the slotted tubular member through the at least one seaming roller.

37. A method of forming a slotted tubular member having a plurality of longitudinal slots comprising:

(a) providing at least one seaming roller positioned to contact the outer surface of the slotted tubular member for transverse movement across the plurality of slots;

(b) detecting a width of each of the plurality of slots to generate a detection signal proportional to the detected width;

(c) comparing the detected width of the slots to a set value indicative of a desired end slot width to generate a correction-signal-proportional to the difference;

(d) applying a downward force onto the slotted tubular member with the at least one seaming roller; and (e) varying the force applied by the at least one seaming roller to the plurality of slots along the slotted tubular member in response to the correction signal so that each opening has a profile with a width tolerance, that throughout the length of the slot profile, varies no more than +/−0.0381 mm from the desired end slot width.

38. The method of claim 37, further comprising detecting the final width of each of the plurality of slots, generating a final width signal proportional to the detected final width, and comparing the final width signal to the set value indicative of the desired end slot width.

39. The method of claim 38, further comprising varying the force applied by the at least one seaming roller to the plurality of slots along the slotted tubular member in response to a final correction signal proportional to the difference between the final width signal and the set value indicative of the desired end slot width.

40. An apparatus for reducing the width of a plurality of longitudinal slots or other openings spaced circumferentially around a slotted tubular member comprising:

(a) a seaming roller positioned to contact the outer surface of the slotted tubular member for transverse movement across the plurality of slots, and adapted to apply a force onto the slotted tubular member so as to reduce the slot width;

(b) first detector adjacent the seaming roller for detecting a width of the plurality of slots and generating a detection signal proportional to the detected width;

(c) a comparator connected to the first detector for comparing the detected width to a set value indicative of a desired end slot width and to generating a correction signal proportional to the difference;

(d) an adjustor connected to the seaming roller and the comparator, for adjusting the force applied by the seaming roller to the plurality of slots in response to the correction signal.

41. A method of reducing the width of a plurality of longitudinal slots or other openings spaced circumferentially around a slotted tubular member, comprising:

(a) providing at least one seaming roller positioned to contact the outer surface of the slotted tubular member for transverse movement across the plurality of slots;

(b) detecting a width of each of the plurality of slots to generate a detection signal proportional to the detected width;

(c) comparing the detected width of the slots to a set value indicative of a desired end slot width to generate a correction signal proportional to the difference;

(d) applying a downward force onto the slotted tubular member with the at least one seaming roller; and (e) varying the force applied by the at least one seaming roller to the plurality of slots along the slotted tubular member in response to the correction signal.

42. A method of forming a slotted tubular member having a plurality of longitudinal slots comprising:

(a) providing at least one seaming roller positioned to contact the outer surface of the slotted tubular member for transverse movement across the plurality of slots;

(b) detecting a width of each of the plurality of slots to generate a detection signal proportional to the detected width, (c) comparing the detected width of the slots to a set value indicative of a desired end slot width to generate a correction signal proportional to the difference;

(d) applying a downward force onto the slotted tubular member with the at least one seaming roller; and (e) varying the force applied by the at least one seaming roller to the plurality of slots along the slotted tubular member in response to the correction signal so that each opening has a profile with a width tolerance, that throughout the length of the slot profile, varies no more than +/−0.0127 mm from the desired end slot width.

43. A method of forming a slotted tubular member having a plurality of longitudinal slots comprising:

(a) providing at least one seaming roller positioned to contact the outer surface of the slotted tubular member for transverse movement across the plurality of slots;

(b) detecting a width of each of the plurality of slots to generate a detection signal proportional to the detected width;

(c) comparing the detected width of the slots to a set value indicative of a desired end slot width to generate a correction signal proportional to the difference;

(d) applying a downward force onto the slotted tubular member with the at least one seaming roller; and (e) varying the force applied by the at least one seaming roller to the plurality of slots along the slotted tubular member in response to the correction signal so that each opening has a profile with a width tolerance, that throughout the length of the slot profile, varies no more than +/−0.00762 mm from the desired end slot width.

* * * * *